US005699689A

United States Patent [19]

Yamanaka

[11] Patent Number: 5,699,689

[45] Date of Patent: Dec. 23, 1997

[54] METHOD OF AND APPARATUS FOR FORMING A DISC-SHAPED BLANK

[75] Inventor: Shigeaki Yamanaka, Hiroshima, Japan

[73] Assignee: Kubota Iron Works Co., Ltd., Hiroshima, Japan

[21] Appl. No.: 665,693

[22] Filed: Jun. 18, 1996

[30] Foreign Application Priority Data

Jun. 30, 1995 [JP] Japan ..... HEI7-165845

[51] Int. Cl.[6] ..... B21H 5/02

[52] U.S. Cl. ..... 72/68; 72/110; 29/892

[58] Field of Search ..... 72/68, 84, 85, 72/110; 29/892, 892.2, 893.32, 894.324

[56] References Cited

U.S. PATENT DOCUMENTS

| | | | |
|---|---|---|---|
| 5,072,509 | 12/1991 | Bichel et al. | 29/892.3 |
| 5,237,745 | 8/1993 | Yamanaka . | |
| 5,396,787 | 3/1995 | Kanemitsu . | |

FOREIGN PATENT DOCUMENTS

| | | |
|---|---|---|
| 45-15871 | 6/1970 | Japan . |
| 53-46197 | 12/1978 | Japan . |
| 62-124043 | 6/1987 | Japan . |
| 63-30139 | 2/1988 | Japan . |
| 63-60037 | 3/1988 | Japan . |
| 3-47645 | 2/1991 | Japan . |
| 4-37432 | 2/1992 | Japan . |
| 4-279239 | 10/1992 | Japan . |
| 6-63670 | 3/1994 | Japan . |
| 6-182470 | 7/1994 | Japan . |
| 6-323399 | 11/1994 | Japan . |
| 7-42811 | 2/1995 | Japan . |
| 7-47439 | 2/1995 | Japan . |
| 7-290181 | 11/1995 | Japan . |
| 2045665 | 11/1980 | United Kingdom . |

*Primary Examiner*—Lowell A. Larson

*Attorney, Agent, or Firm*—Armstrong, Westerman, Hattori, McLeland & Naughton

[57] ABSTRACT

There is provided a method for forming a disc-shaped blank in which a disc-shaped thin plate material is, at an outer peripheral portion thereof, swaged towards an axial side of the plate material with a roll die to thicken the outer peripheral portion and is shaped into a cross-sectional configuration corresponding to that of a dish, the method comprises the steps of: sandwiching and securing between a pair of sandwiching members the disc-shaped thin plate material except for the outer peripheral portion including a swaging portion; swaging the swaging portion projecting from the sandwiching members so that an outermost end of the swaging portion may be shaped into a cross-sectional configuration corresponding to that of an arrowhead while a root portion of the swaging portion has the same thickness as the original thin thickness of the plate material; thereafter, bending the outer peripheral portion including the thick-walled swaged portion at the root portion thereof from one side surface of the disc-shaped thin plate material towards the other side direction and forming a bent portion into an L-shaped configuration in cross section so that the bent portion may lie within a predetermined width; and thereafter, forging the bent portion in a closed state so that an inner surface and outer surface thereof may each have predetermined dimensions.

3 Claims, 9 Drawing Sheets

METHOD OF AND APPARATUS FOR FORMING A DISC-SHAPED BLANK

BACKGROUND OF THE INVENTION

1. Technical Field of the Invention

The present invention relates to a method of and an apparatus for forming from a disc-shaped plate material, a disc-shaped blank with a cross-sectional configuration corresponding to that of a dish and having a thick-walled outer peripheral portion, for use as a blank material of a rotary member such as a drive gear in a clutch for a motor vehicle or a flywheel.

2. Description of the Prior Art

The present inventor has disclosed a forming method of this sort in the prior art, U.S. Pat. No. 5,237,745 that is directed to a technique for manufacturing a drive plate.

A method of forming a disc-shaped blank as disclosed in U.S. Pat. No. 5,237,745 is illustrated in FIGS. 1 to 4 of the accompanying drawings. First, as shown in FIG. 1, a disc-shaped thin plate material 1 is, at the axial side thereof and thus except for an outer peripheral portion 1*a* thereof to be swaged later, sandwiched and secured between a fixing bed 2 and a pushing plate 3, and is fixed in position by using a positioning pin 4. Then, as shown in FIG. 2, the outer peripheral portion 1*a* of the disc-shaped plate material 1 is swaged towards the axial side thereof with a first swaging die 5 in a first swaging process. As a result of this swaging process, the outer peripheral portion 1*a* is shaped into a cross-sectional configuration corresponding to that of an arrowhead as shown. Thereafter, as shown in FIG. 3, the first swaged outer peripheral portion 1*a* of the disc-shaped plate material 1 is further swaged with a second swaging die 6 in a second swaging process so that it may be shaped into a configuration which is rectangular in cross section. Subsequently, as shown in FIG. 4, the twice swaged disc-shaped plate material 1 is pressed with a lower die 7 and an upper die 8 to bend an inner side of the outer peripheral portion 1*a* and to form a thickened circumferential portion thereof that extends in an axial direction, thereby enabling a dish configured, disc-shaped blank 9 to be obtained.

In the method of forming a disc-shaped blank disclosed in U.S. Pat. No. 5,237,745, however, since the thickened portion that constitutes the outer peripheral portion of the disc-shaped blank which acquires a cross-sectional configuraton corresponding to that of a dish is preliminarily shaped symmetrically in the direction of thickness of the disc-shaped plate material 1 and the thickened, then shaped portion is thereafter bent to provide a dish like configuration, it has been found that there develops an extremely large stress that acts on the angular portion, designated at A, of the above-mentioned bent inner side and hence the problem is brought about that a crack or a groove may be created in the above-mentioned angular portion.

Accordingly, in case the crack or the groove is created in the angular portion of the bent inner side, it is unavoidable that the strength of gear teeth will be weakened when the gear teeth are formed on the outer peripheral portion of the above-mentioned disc-shaped blank by using a gear teeth spinning machine or a gear teeth cutting machine.

SUMMARY OF THE INVENTION

The present invention has been made in order to resolve the above-mentioned problem and has its object to provide a method and an apparatus which are capable of forming a disc-shaped blank with a cross-sectional configuration corresponding to that of a dish and having a thick-walled outer peripheral portion, without causing the formation of a crack and a groove at an angular portion in the inner side thereof.

In order to achieve the object mentioned above, there is provided in accordance with the present invention in a first aspect thereof a method of forming a disc-shaped blank in which a disc-shaped thin plate material is, at an outer peripheral portion thereof, swaged towards an axial side of the plate material with a roll die to thicken the outer peripheral portion and is shaped into a cross-sectional configuration corresponding to that of a dish, characterized in that the method comprises the steps of: sandwiching and securing between a pair of sandwiching members the disc-shaped thin plate material except for the outer peripheral portion including a swaging portion; swaging the swaging portion projecting from the sandwiching members so that an outermost end of the swaging portion may be shaped into a cross-sectional configuration corresponding to that of an arrowhead and thus may be also thick-walled while a root portion of the swaging portion has the same thickness as the original thin thickness of the plate material; thereafter, bending the outer peripheral portion including the thick-walled swaged portion at the root portion thereof from one side surface of the disc-shaped thin plate material towards the other side direction and forming a bent portion into an L-shaped configuration in cross section so that the bent portion may lie within a predetermined width; and thereafter, forging the bent portion in a closed state so that an inner surface and outer surface thereof may each have predetermined dimensions.

Also, according to a further feature of the present invention, the method of forming a disc-shaped blank is characterized in that the step of swaging is performed at least twice, in which the outer peripheral portion of the plate material is shaped into the cross-sectional configuration corresponding to that of the arrowhead, and thereby the arrowhead in cross-sectional configuration is in a stepwise manner increased from an outermost end of the outer peripheral portion to a portion in the vicinity of the root portion.

The present invention also provides, in a second aspect thereof, an apparatus for forming a disc-shaped blank in which a disc-shaped thin plate material is, at an outer peripheral portion thereof, swaged towards an axial side of the plate material with a roll die to thicken the outer peripheral portion and is shaped into a cross-sectional configuration corresponding to that of a dish, characterized in that the apparatus comprises: a pair of sandwiching members for sandwiching and securing between them the disc-shaped thin plate material except for the outer peripheral portion including a swaging portion; a swaging means for swaging the swaging portion projecting from the sandwiching members so that an outermost end of the swaging portion may be shaped into a cross-sectional configuration corresponding to that of an arrowhead and thus may be also thick-walled while a root portion of the swaging portion has the same thickness as the original thin thickness of the plate material; a bending means for bending the outer peripheral portion including the thick-walled swaged portion at the root portion thereof from one side surface of the disc-shaped thin plate material towards the other side direction and forming a bent portion into an L-shaped configuration in cross section so that the bent portion may lie within a predetermined width; and a forging means for forging the bent portion in a closed state so that an inner surface and outer surface thereof may each have predetermined dimensions.

The advantage obtained in accordance with the present invention is that by swaging a swaging portion projecting from the sandwiching members so that the swaging portion may be shaped into a cross-sectional configuration corresponding to that of an arrowhead and thus may be also thick-walled while a root portion of the swaging portion has the same thickness as the original thin thickness of the plate material and, by bending the outer peripheral portion including the thick-walled swaged portion at the root portion thereof from one side surface of the disc-shaped thin plate material towards the other side direction and forming a bent portion into an L-shaped configuration in cross section so that the bent portion may lie within a predetermined width, and, thereafter, by forging the bent portion in a closed state so that an inner surface and outer surface thereof may each have predetermined dimensions, a disc-shaped blank with a thick-walled peripheral portion and having a cross-sectional configuration corresponding to that of a dish can be formed by using a swaging process, without causing a crack and a groove at an angle portion in the inner side of the outer peripheral portion.

Also, by performing at least twice the step of swaging in which the swaging portion is shaped into the cross-sectional configuration corresponding to that of an arrowhead, and by increasing the arrowhead in the cross-sectional configuration in a stepwise manner from an outermost end of the outer peripheral portion to a portion in the vicinity of the root portion, the formation of the arrowhead in cross-sectional configuration can be smoothly carried out to the portion in the vicinity of the root portion of the swaging portion.

BRIEF DESCRIPTION OF THE DRAWINGS

These and other objects, features and advantages of the present invention will become more readily apparant from a reading of the following description that is made with reference to the accompanying drawings in which.

DESCRIPTION OF THE PREFERRED EMBODIMENTS

An explanation will be now given with respect to a certain embodiment according to the present invention with reference to FIG. 5 to FIG. 9.

Figure 1:
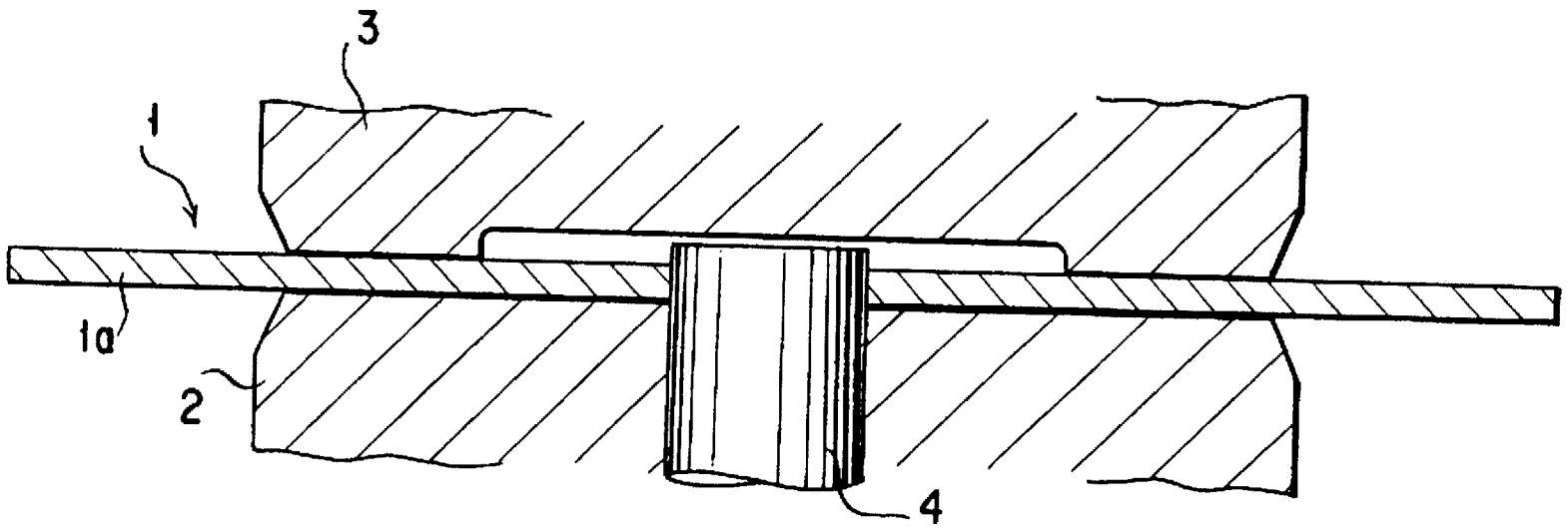
FIG. 1 PRIOR ART
FIG. 1 is a cross-sectional view diagrammatically illustrating a state in which a disc-shaped thin plate material is fixedly secured in position for a swaging operation in the forming method in the prior art.
Figure 2:
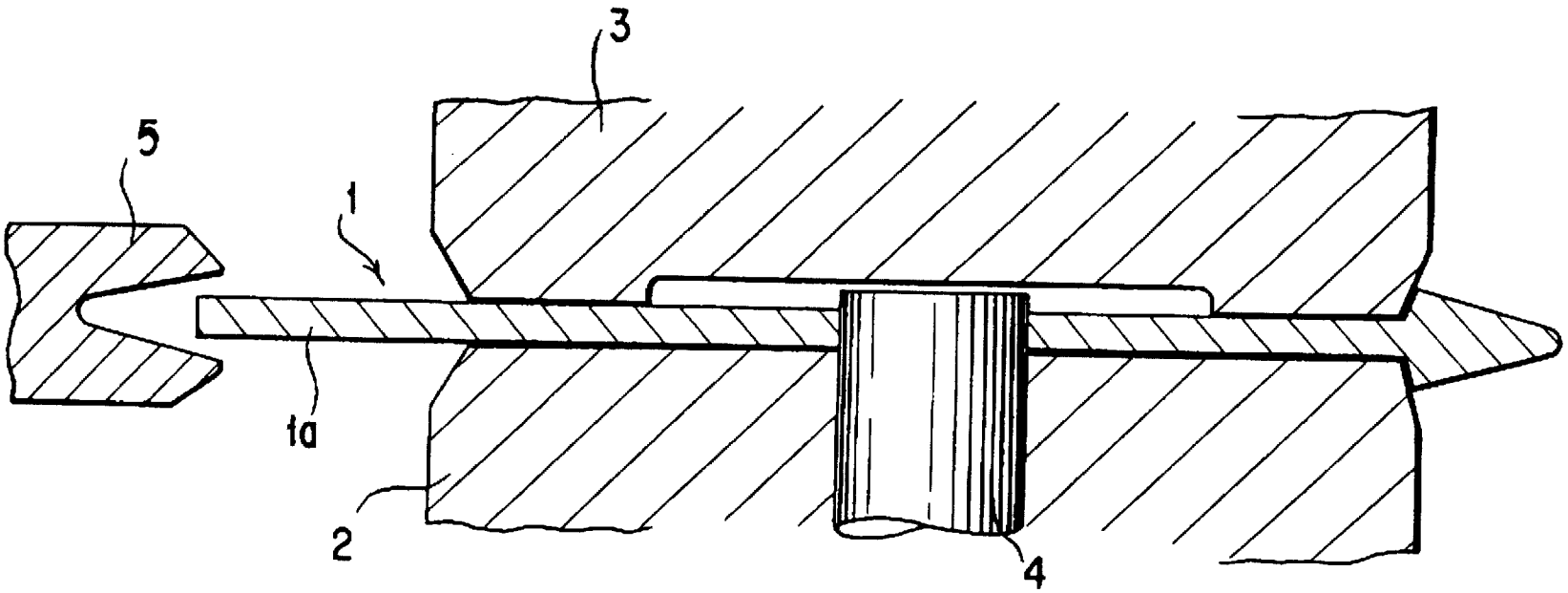
FIG. 2 PRIOR ART
FIG. 2 is a cross-sectional view diagrammatically illustrating a first machining process in the forming method in the prior art.
Figure 3:
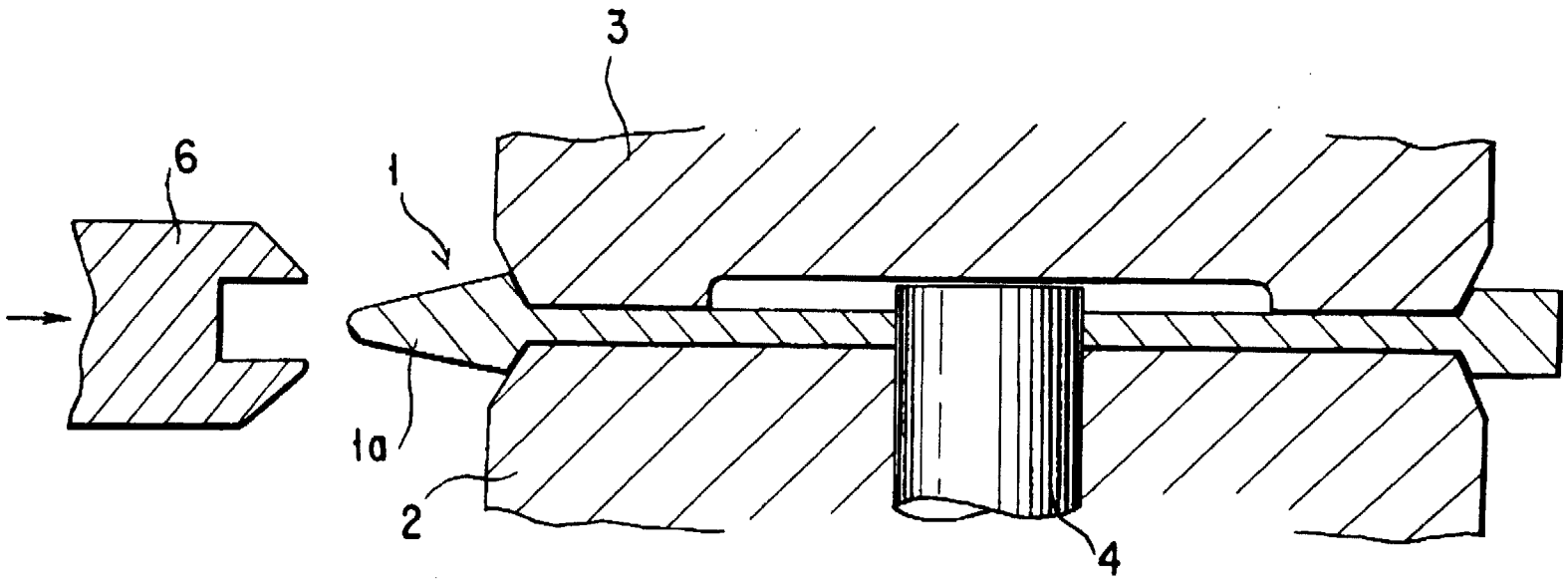
FIG. 3 PRIOR ART
FIG. 3 is a cross-sectional view diagrammatically illustrating a second machining process in the forming method in the prior art.
Figure 4:
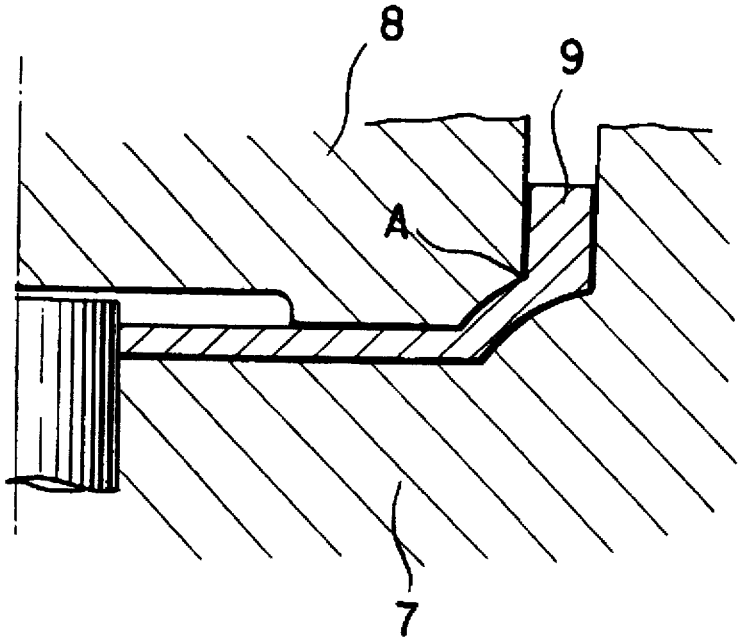
FIG. 4 PRIOR ART
FIG. 4 is a cross-sectional view diagrammatically illustrating a third machining process in the forming method in the prior art.
Figure 5:
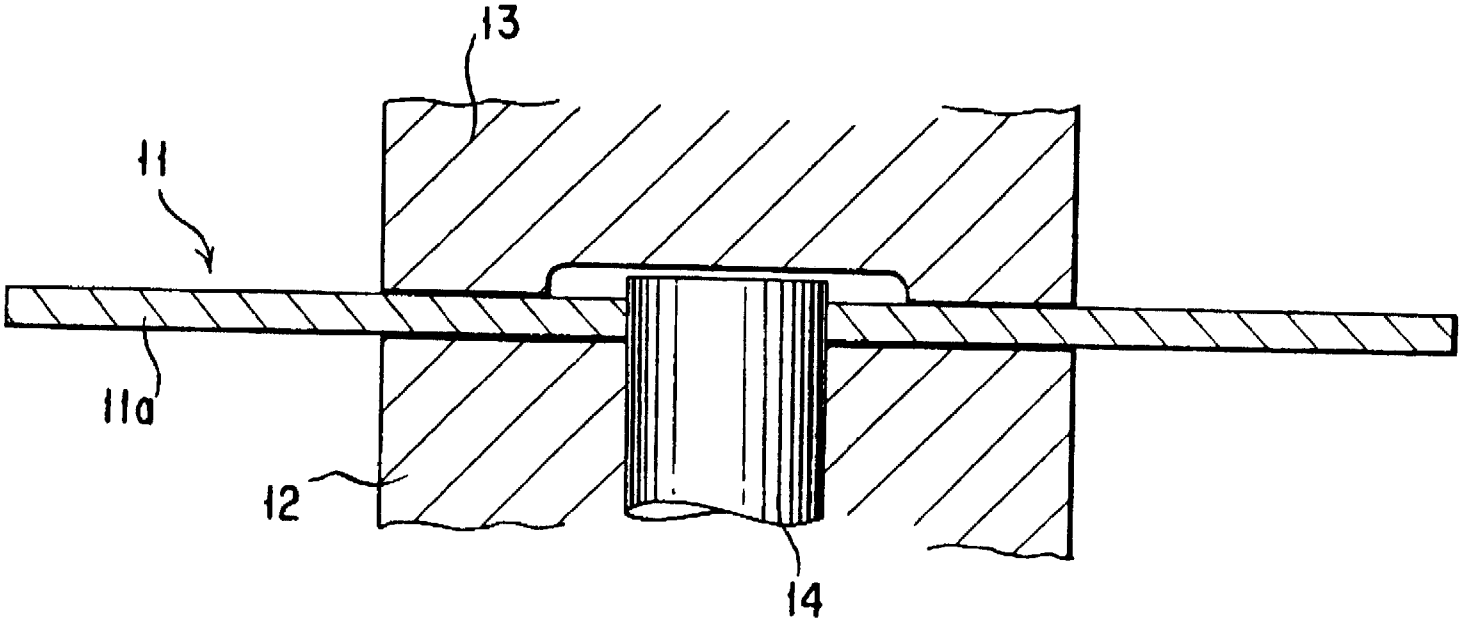
FIG. 5 is a cross-sectional view diagrammatically illustrating a state in which a disc-shaped thin plate material is fixedly secured in position for a swaging operation in a certain embodiment according to the present invention.

As shown in FIG. 5, a disc-shaped thin plate material 11 which has been formed by die punching a plate material having a thickness of 2 to 3 mm into a circular configuraton is, at the axial side thereof and thus except for an outer peripheral portion including a swaging portion 11*a*, sandwiched and secured between a fixing bed 12 and a pushing plate 13. At this state, a positioning of the plate material 11 is effected by fitting a positioning pin 14 that is disposed at an axial part of the fixing bed 12 into a hole formed through an axial part of the plate material 11.

Figure 6A:
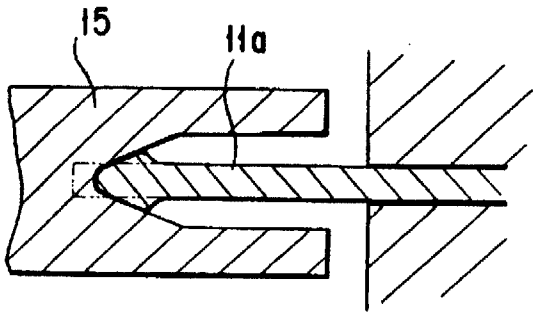
FIG. 6A is a cross-sectional view diagrammatically illustrating in the initial machining state of a first machining process in the embodiment according to the present invention.
Figure 6B:
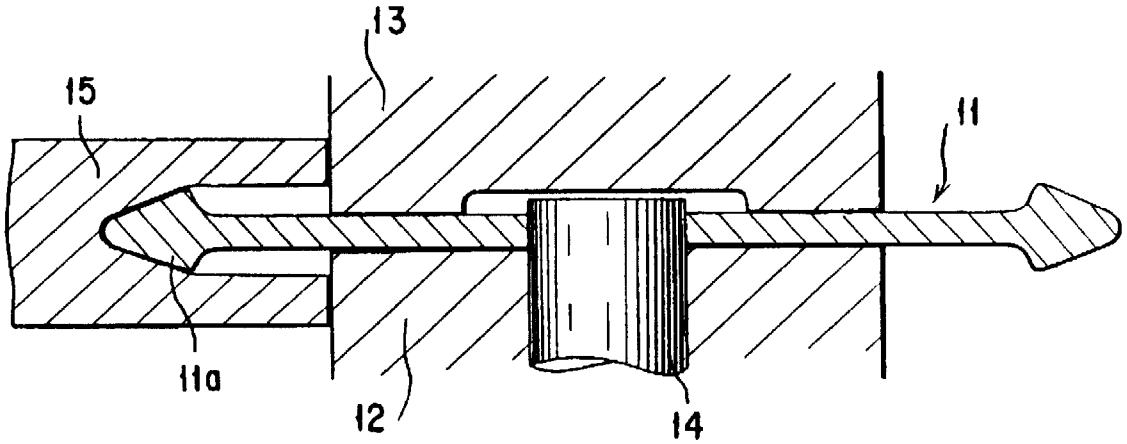
FIG. 6B is a cross-sectional view diagrammatically illustrating in the final machining state of the first machining process in the embodiment according to the present invention.

First Step:

As shown in FIG. 6A, with a first roll die 15 a first swaging process is carried out for the swaging portion 11*a* which is to be swaged from its outer peripheral side towards its axial side while the first roll die 15 and the plate material 11 are being synchronously rotated. The swaged configuration in cross section made in this first swaging process here is taken to assume a short arrowhead as shown in FIG. 6B. Also, in this case, a root portion of the swaging portion 11*a* is kept free of the first roll die 15. And the swaging portion 11*a* is so thickened as to be the form of an arc from the original thin thickness of the disc-shaped thin plate material 11 up to a maximum thickness of the arrowhead configuration.

Figure 7A:
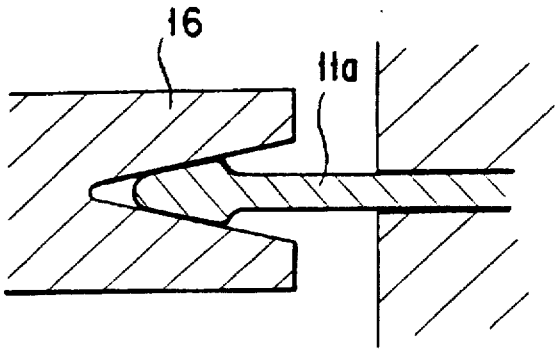
FIG. 7A is a cross-sectional view diagrammatically illustrating in the initial machining state of a second machining process in the embodiment according to the present invention.
Figure 7B:
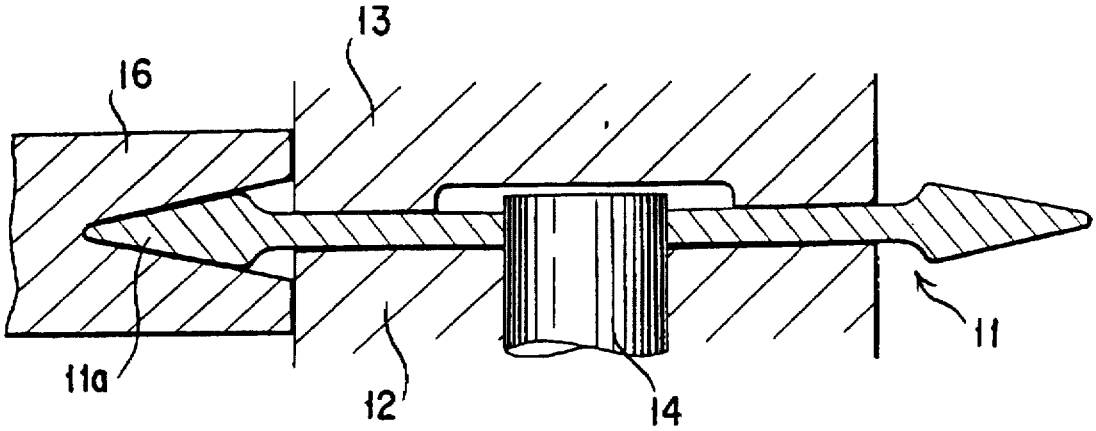
FIG. 7B is a cross-sectional view diagrammatically illustrating in the final machining state of the second machining process in the embodiment according to the present invention.

Second Step:

The swaging portion 11*a* that has been rendered into the above-mentioned short arrowhead in cross section is, as shown in 7A, then subjected to a second swaging process with a second roll die 16 while the second roll die 16 and the disc-shaped plate material 11 are being synchronously rotated as in the first step. The swaging configuration in the second swaging process here is taken to assume a long arrowhead in cross section, as shown in FIG. 7B, extending to the root portion of the swaging portion 11*a*. In this case, the root portion of the swaging portion 11*a* is here again kept free of the roll die 16 and has the same thickness as the original thin thickness of the plate material 11.

Figure 8A:
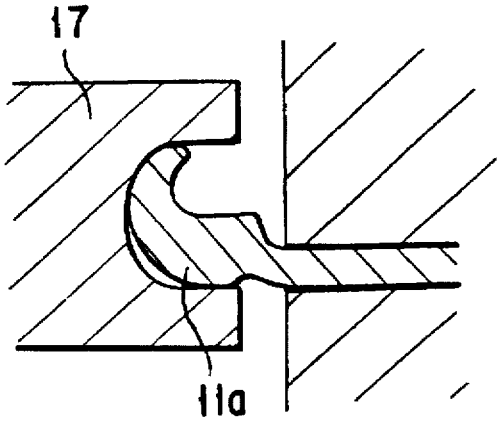
FIG. 8A is a cross-sectional view diagrammatically illustrating in the initial machining state of a third machining process in the embodiment according to the present invention.
Figure 8B:
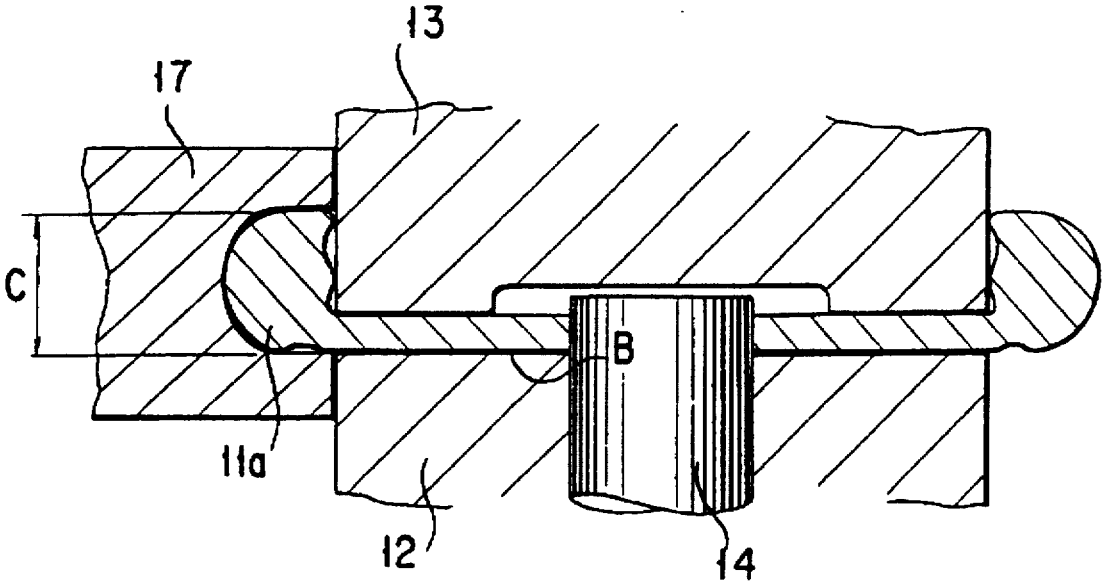
FIG. 8B is a cross-sectional view diagrammatically illustrating in the final machining state of the third machining process in the embodiment according to the present invention.

Third Step:

The swaging portion 11*a* which has been rendered into the above-mentioned long arrowhead in cross section, as shown in FIG. 8A, is subjected to a third swaging process with a third roll die 17 while the third roll die 17 and the disc-shaped plate material 11 are being synchronously rotated. The swaging configuration obtained in the third swaging process here is taken to assume a configuration whose cross section represents that of an approximate semi-cylinder, as shown in FIG. 8B, that results from bending the swaged portion 11*a*, which is the arrowhead in cross section having been formed in the second swaging process, at the root portion thereof from one side surface B of the disc-shaped plate material 11 towards the other side direction.

It should be noted here that the bent width C of the forming configuration in the above-mentioned third step is made approximately identical to the bent width of a formed product. It should be also noted that the bent inner portion is made partially in contact with the peripheral surface of the pushing plate 13 or the fixing bed 12.

Figure 9:
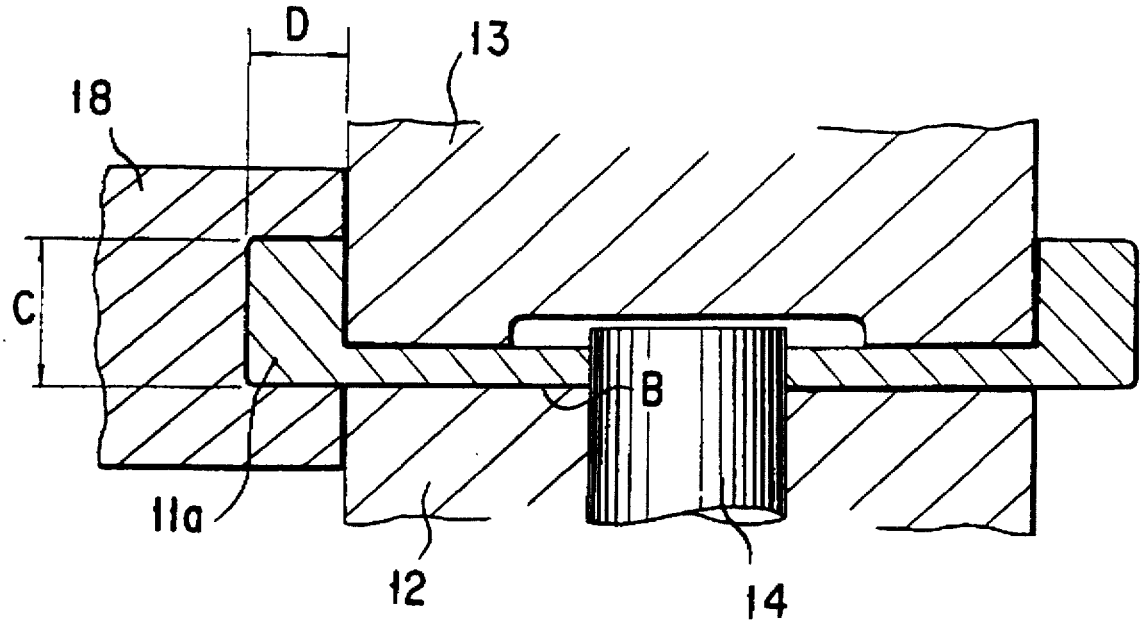
FIG. 9 is a cross-sectional view diagrammatically illustrating a fourth machining process in the embodiment according to the present invention.

Fourth Step:

As shown in FIG. 9, the bent swaged portion 11*a* is forged in a closed state with a fourth roll die 18 so that the resulting portion 11*a* may have a predetermined bent width C and a predetermined thickness D. The swaged portion 11*a* rendered in the bent state is thereby formed orthogonally, without causing a crack and a groove in its inner angular areas.

While the present invention has hereinbefore been described with respect to certain illustrative embodiments thereof, it will readily be appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all equivalents thereof.

What is claimed is:

1. A method of forming a disc-shaped blank in which a disc-shaped plate material is, at an outer peripheral portion thereof, swaged towards an axial side of said plate material with a roll die to thicken said outer peripheral portion and is shaped into a cross-sectional configuration corresponding to that which is generally a horizontally elongated and vertically shortened letter "U", characterized in that said method comprises the steps of:

a) sandwiching, securely between a pair of sandwiching members, said disc-shaped thin plate material except for said outer peripheral portion including a swaging portion projecting from said sandwiching members;

b) swaging exclusively said swaging portion so that an outermost end thereof may be shaped into a configuration which in cross-section is generally triangular having an outwardly tapered side surface and a rounded top and thus may also be thick-walled while a root portion of said plate material that is sandwiched between said sandwiching members remains in a thin thickness original of said plate material;

c) thereafter, bending said outer peripheral portion including said swaged portion at a site adjacent to said root portion thereof from one side surface of said plate material towards a direction of the other side surface thereof and forming a bent portion into an L-shaped configuration in cross section so that said bent portion may lie within a predetermined width; and thereafter, forging said bent portion in a closed state to assume a configuration which is rectangular in cross section so that an inner surface and outer surface thereof may each have predetermined dimensions.

2. The method as set forth in claim 1, characterized in that said step of swaging in which said outer peripheral portion of said plate material is shaped into a configuration which in cross section is generally triangular having an outwardly tapered side surface and a rounded top is performed at least twice, whereby said generally triangular cross-sectional configuration having said outwardly tapered side surface is, stepwise, narrowed in its taper angle and increased in its length from the outermost end of said outer peripheral portion to said site.

3. A apparatus for forming a disc-shaped blank in which a disc-shaped thin plate material is, at an outer peripheral portion thereof, swaged towards an axial side of said plate material with a roll die to thicken said outer peripheral portion and is shaped into a cross-sectional configuration corresponding to that which is generally a horizontally elongated and vertically shortened letter "U", characterized in that said apparatus comprises:

a pair of sandwiching members for sandwiching and securing between them, said disc-shaped thin plate material except for said outer peripheral portion including a swaging portion projecting from said sandwiching members;

swaging means for swaging exclusively said swaging portion so that an outermost end thereof may be shaped into a configuration which in cross-section is generally triangular having an outwardly tapered side surface and a rounded top and thus may also be thick-walled while a root portion of said plate material that is sandwiched between said sandwiching members remains in a thin thickness original of said plate material;

bending means for bending said outer peripheral portion including said swaged portion at a site adjacent to said root portion thereof from one side surface of said plate material towards a direction of the other side surface thereof and forming a bent portion into an L-shaped configuration in cross section so that said bent portion may lie within a predetermined width; and forging means for forging said bent portion in a closed state to assume a configuration which is rectangular in cross section so that an inner surface and outer surface thereof may each have predetermined dimensions.

* * * * *